United States Patent [19]

Kühn

[11] 4,314,613

[45] Feb. 9, 1982

[54] PILE-DRIVING RECOIL DAMPING DEVICE

[75] Inventor: Hans Kühn, Hamburg, Fed. Rep. of Germany

[73] Assignee: Koehring GmbH, Ellerau, Fed. Rep. of Germany

[21] Appl. No.: 184,888

[22] Filed: Sep. 8, 1980

Related U.S. Application Data

[63] Continuation of Ser. No. 894,850, Apr. 10, 1978, Pat. No. 4,262,755.

[30] Foreign Application Priority Data

Apr. 15, 1977 [DE] Fed. Rep. of Germany ..... 2716701

[51] Int. Cl.[3] ..... B25D 17/06; E02D 13/10

[52] U.S. Cl. ..... 173/131; 173/139

[58] Field of Search ..... 173/128, 131, 133, 139, 173/162, DIG. 1; 405/232

[56] References Cited

U.S. PATENT DOCUMENTS

| | | | |
|---|---|---|---|
| 886,193 | 4/1908 | DeWitt | 173/131 |
| 2,558,165 | 6/1951 | Anderson | 173/139 X |
| 3,417,828 | 12/1968 | Duyster et al. | 405/232 X |
| 3,797,585 | 3/1974 | Ludvigson | 173/131 |
| 4,043,405 | 8/1977 | Kuhn | 173/133 X |
| 4,262,755 | 4/1981 | Kuhn | 173/139 X |

FOREIGN PATENT DOCUMENTS

| | | | |
|---|---|---|---|
| 1634325 | 6/1970 | Fed. Rep. of Germany | 173/133 |
| 2454521 | 5/1976 | Fed. Rep. of Germany | 173/162 |
| 1183422 | 3/1970 | | |
| 281264 | 10/1971 | U.S.S.R. | 173/131 |

*Primary Examiner*—Werner H. Schroeder
*Assistant Examiner*—Andrew M. Falik
*Attorney, Agent, or Firm*—Michael J. Striker

[57] ABSTRACT

A pile driver has a hollow and elongated cylindrical housing. Within the housing, a ram can slide upwardly and downwardly in order to provide the force which can drive a pile into dense strata of the earth. A follower, located partially inside the housing and extending out of the bottom thereof, is struck by the ram and is thus interposed between the ram and the pile to be driven when the device is operated. Various devices are disclosed which serve as shock absorbers, the devices cooperating with the follower and with the housing in order to absorb recoil shock which is reflected back to the pile driver after a blow has been transmitted to the pile by the ram via the follower. These devices are so designed that the exterior diameter of the housing does not have to be substantially increased, which allows the pile driver thus manufactured to drive piles through surrounding guides.

7 Claims, 3 Drawing Figures

PILE-DRIVING RECOIL DAMPING DEVICE

This is a continuation of application Ser. No. 894,850, filed Apr. 10, 1978, U.S. Pat. No. 4,262,755.

BACKGROUND OF THE INVENTION

The present invention relates to an impacting arrangement in general, and more particularly to pile drivers.

Pile-drivers of various constructions are already known and in widespread use. Usually, the include a housing which receives an impacting body, such as a ram, and allows it to move up and down, parallel to the longitudinal axis of the pile to be driven. A conventional pile-driver also may include a slidable impact-transmitting ram follower which is interposed between the free end of the pile to be driven and the ram.

A device of this type is disclosed in the German published patent application DT-OS No. 2,454,488.

In this device, a plurality of annular rubber elements is arranged between the housing and the ram follower around that surface of the follower which is struck by the ram. These annular rubber elements serve to protect the housing from the recoil forces which are reflected back from the ram follower to the housing immediately after the ram strikes the ram follower. Here, a relatively huge elastic value is necessary to absorbing recoil energy. Since all the elements must surround the surface of the follower which is struck by the ram, and must be spaced from each other, the housing must be enlarged to accommodate the elements and must have a considerably greater diameter than that of the pile to be driven. During operation of this device, this diameter difference subjects the housing to considerable bending stresses. Also, the enlarged housing prevents closely-spaced piles from being driven independently. In such instances, the protection against the recoil must be dispensed with altogether, or must be reduced to such an extent that the durability of the device is adversely affected.

In order to anchor offshore drilling platforms on the continental shelf or the like, tubular piles are now used which have a diameter of about 1 meter and a length of 100 meters or more. These piles require very high impacts in order to drive them into the bottom strata. The devices which are used for this purpose have large-diameter rams, to reduce the specific surface pressures by increasing surface area and thereby increasing their durability. Since the piles used in this application are considerably resiliently deformed on impact because of their large lengths, and since they thus transmit a high amount of energy to these devices during their recoil, it is necessary to protect the devices from damage caused by the recoil. Conventionally, this requires enlargement of the housing. Inasmuch as tubular piles which are being used in the offshore pile-driving operations are usually guided in pile guides which are fitted to the outer diameter of the tubular piles, an enlarged housing cannot drive a pile past the top of its guide, because the housing is too big to enter the guide.

SUMMARY OF THE INVENTION

Accordingly, it is a general object of the present invention to avoid the disadvantages of the prior art.

More specifically, it is an object of the present invention to so construct a pile-driver in which protection of the housing from the effect of the recoil is improved and in which the housing is only slightly larger than the pile to be driven. A concomitant object of the present invention is to develop a pile-driver which is simple, durable, reliable and inexpensive to manufacture and operate.

In this invention, the force which is actually applied to the pile to be driven is supplied by a ram, which can slide upwardly and downwardly within an elongated hollow cylindrical housing. Furthermore, an anvil or follower is used, which can slide upwardly and downwardly within the housing and extends out of the bottom of the housing. This follower is placed on top of the pile to be driven and thus transmits the force of the ram to the pile. In this invention, three embodiments are taught which cooperate with the housing and the follower in order to absorb recoil shock.

In all three embodiments disclosed herein, at least one piston is used. One end of the piston is inserted into a chamber, and can increase and decrease the volume of the chamber as the piston moves in and out. The chamber contains a gas which is pressurized to a superatmospheric pressure. The other end of the piston will move up and down with the follower. In principle, all embodiments operate by causing the recoil shock which is transmitted to the follower to be in turn transmitted to the piston or pistons, which in turn move into the chamber or chambers and compress the gas therein until equilibrium is established. In this fashion, the gas is used to absorb the recoil shock.

In all embodiments, the chambers and the pistons are so designed that they can absorb huge forces generated by shocks developed during the pile-driving process. Moreover, the devices are so designed that they do not necessitate an increase in diameter of the housing. In this fashion, the housing can remain sufficiently thin so as to drive piles through guides that are used to support piles that are to be used to support offshore-drilling platforms and the like.

In the first embodiment, a cylindrical piston is utilized which encircles the follower entirely around its circumference. In this embodiment, the chamber is formed by a notch in the surrounding housing. The housing is provided with a valve that allows the shock-absorbing medium to be introduced into the chamber. In a second embodiment, there are a plurality of vertically elongated pistons which always abut the follower at their lower ends, their upper ends being located in chambers which are formed not by notches, but rather by bores which are located in an annular flange which extends radially inwardly from the wall of the housing. In a third embodiment, a two-stage series of pistons is used, in which one central impact piston which is initially designed to be struck by the ram drives a plurality of other pistons that surround the follower and abut a flange which extends radially inwardly from the housing. This third embodiment has the advantage that the impact characteristics achieved by utilization of this embodiment are particularly advantageous for use in loosening and driving piles.

In all three embodiments, a liquid is utilized which compresses the gas. As will be seen hereinafter, the chambers are filled not by gas alone, but also with liquid, in order to prevent gas leakage from eventually vitiating the effect of the invention.

A further aspect of the present invention resides in the fact that the housing component and the impact-transmitting component have respective dimensions which exceed those of the respective pile by at most 10%. Preferably, however, the dimensions of the components approximate those of the respective pile.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
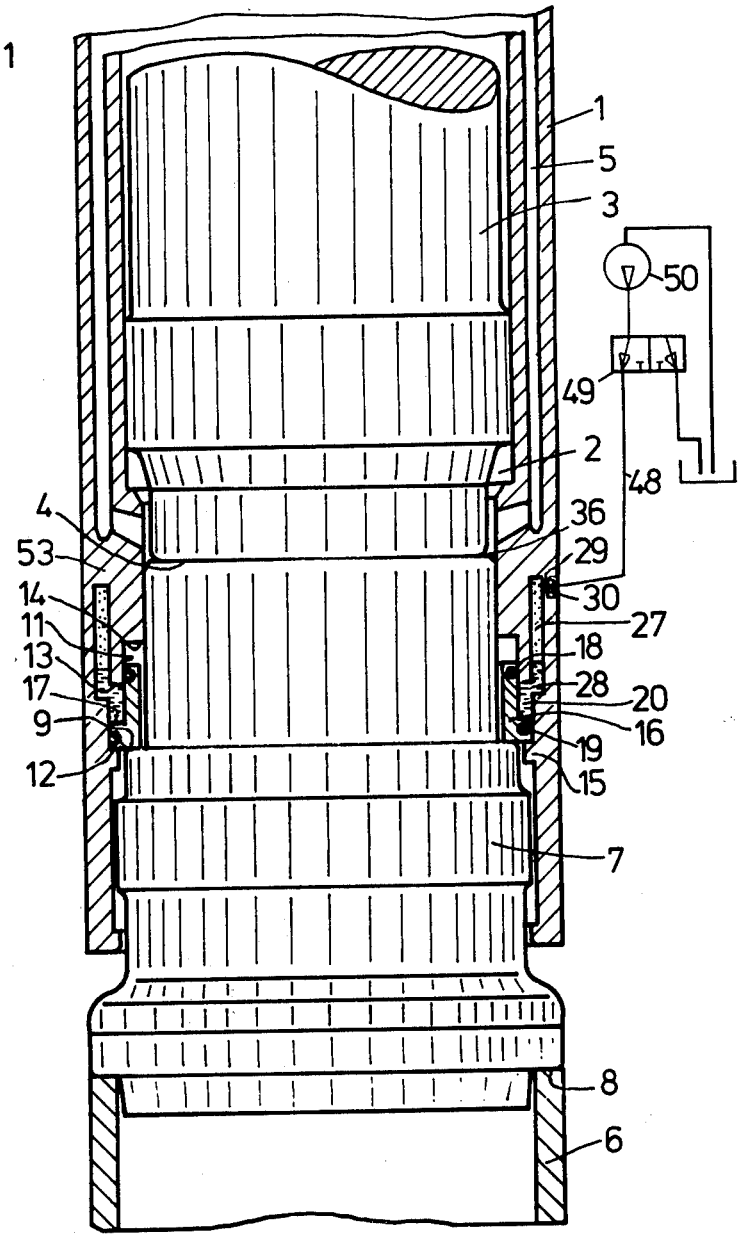
FIG. 1 is a partially sectioned side elevational view of a lower portion of the present invention.

Referring now to the drawings in detail, and first to FIG. 1 thereof, it may be seen that the reference numeral 1 has been used to designate a hollow axially elongated and cylindrical housing. A ram 3 is received in the interior of the housing component 1 and can slide up and down therein, being movable by conventional reciprocating means (not shown). The interior of the housing 1 is filled with a gas, such as air. The gas which is displaced during movement of ram 3 can flow through axially elongated channels 5 which are provided in the walls of the housing 1. The housing 1 is affixed, on its non-illustrated upper end, to a carrier rope or the like so as to be suspended therefrom and to be able to follow the downward movement of a pile 6.

In this embodiment of the invention, the pile 6 is of a tubular configuration. An impact-transmitting ram follower 7 is arranged between the pile 6 and the impacting body 3. The upper portion of the ram follower 7 is surrounded by the lower portion of the housing 1. An annular striking surface 8 of the ram follower 7 abuts the upper end face of the free uppermost end of the tubular pile 6. The ram follower 7 is of a unitary construction, and has a plurality of cylindrical sections of different diameters. The ram follower 7 also has an annular horizontal ledge surface 9 intermediate its top and bottom, on the top of one of the cylindrical sections.

The cylindrical housing 1 carries on, on its inner surface, and below the path of reciprocation of ram 3 relative to the housing 1, a radially inwardly projecting annular flange 53. Furthermore, the housing 1 includes two cylindrical surfaces 11 and 12 which are arranged underneath annular flange 53 and are separated from one another by annular shoulder 13. The lower cylindrical surface 12 has a diameter which exceeds that of the upper cylindrical surface 11.

A hollow, generally cylindrical piston 16 is guided along the cylindrical surfaces 11 and 12 for limited displacement along the axis of housing 1. Piston 16 has an upwardly facing annular shoulder 17 located at its bottom, and is displaceable between a lower abutment projection 15 provided at the inner surface of the housing component 1, an an upper abutment projection 14 which cooperates with the top of piston 16. An annular hollow space or compartment 20 is bounded between piston 16 and the lower cylindrical surface 12, the height of the compartment 20 being determined by the distance between the annular shoulders 13 and 17.

In this first embodiment illustrated in FIG. 1, the compartment 20 continues upwardly into the annular flange 53 of the housing 1 from shoulder 17 of piston 16. The upper end of compartment 20 jogs outwardly above shoulder 13 and communicates with a pressure medium channel 29 which incorporates a closing valve 30. The pressure medium channel 29 communicates, through a conduit 48 and a switching valve 49, with a pressure medium pump 50.

Liquid and gas are introduced within compartment 20 to form a liquid cushion 28 at the bottom and gas cushion 27 located above the liquid cushion. The pressure in compartment 20 can be controlled by the controlled admission of fluid and/or gas into compartment 20, under such conditions of pressure and volume as will adapt the properties of the gas and liquid to the particular requirements of any specific application.

Toroidal seals 18 and 19 are arranged between cylindrical surfaces 11 and 12 and those outer surfaces of the piston 16 which cooperate therewith, to seal the liquid and gas within compartment 20. The piston 16 is normally pressed by the superatmospheric pressure prevailing in the compartment 20 against support surface 9.

When the circular ramming surface 4 at the bottom of the ram 3 strikes a corresponding circular struck surface 36 located at the top of ram follower 7 during operation, the energy of the impact is transmitted directly to the pile 6 by the annular striking surface 8 which is provided on the bottom of ram follower 7. The recoil (which may be very pronounced, especially when the pile 6 has a substantial length) is transmitted from the pile 6 via striking surface 8 to the ram follower 7. The support surface 9 of ram follower 7, which abuts the radially outermost surface of shoulder 17 on the annular piston 16, forces the piston upwardly against the superatmospheric pressure of the gas cushion 27 inside compartment 20. Inasmuch as the liquid cushion 28 also contained in the compartment 20 is as a practical matter, incompressible, the volume reduction of the compartment 20 which results from lifting of the piston 16 proportionally increases the pressure of the gas cushion 27 as a function of the displacement of piston 16. Thus, piston 16 can be moved upwardly by the energy of the recoil only until equilibrium between the upwardly directed recoil force and the downwardly directed force exerted by the gas cushion has been established.

By adjusting the initial superatmospheric pressure in the compartment 20 to correspond to the recoil forces which are to be expected (based, inter alia, on the dimensions of pile 6, the characteristics of the pile driver, and the resistance of the earth strata into which the pile 6 is to be driven) it is possible to protect the housing from destruction caused by recoil by absorbing recoil energy in the gas cushion. In this manner, an increased lifespan of the pile driver is obtained and the wall thickness and thus the transverse dimensions of the housing 1 can be reduced, which further results in reduction of cost, material consumption, and weight.

Inasmuch as the piston 16 need have only small radial thickness, and inasmuch as compartment 20 is situated at that inner circumferential region of housing 1 which corresponds to the annular shoulder 17 of the piston 16, and inasmuch as compartment 20 may be vertically elongated as needed, it is not necessary to increase the exterior diameter of the housing 1 beyond those dimensions which are required in order to accommodate the ram 3. The housing 1 is preferably cylindrical and the diameter thereof need be only slightly larger than the diameter of the ram 3 and, most advantageously, it may correspond to the exterior diameter of the tubular pile 6 to be driven.

Figure 2:
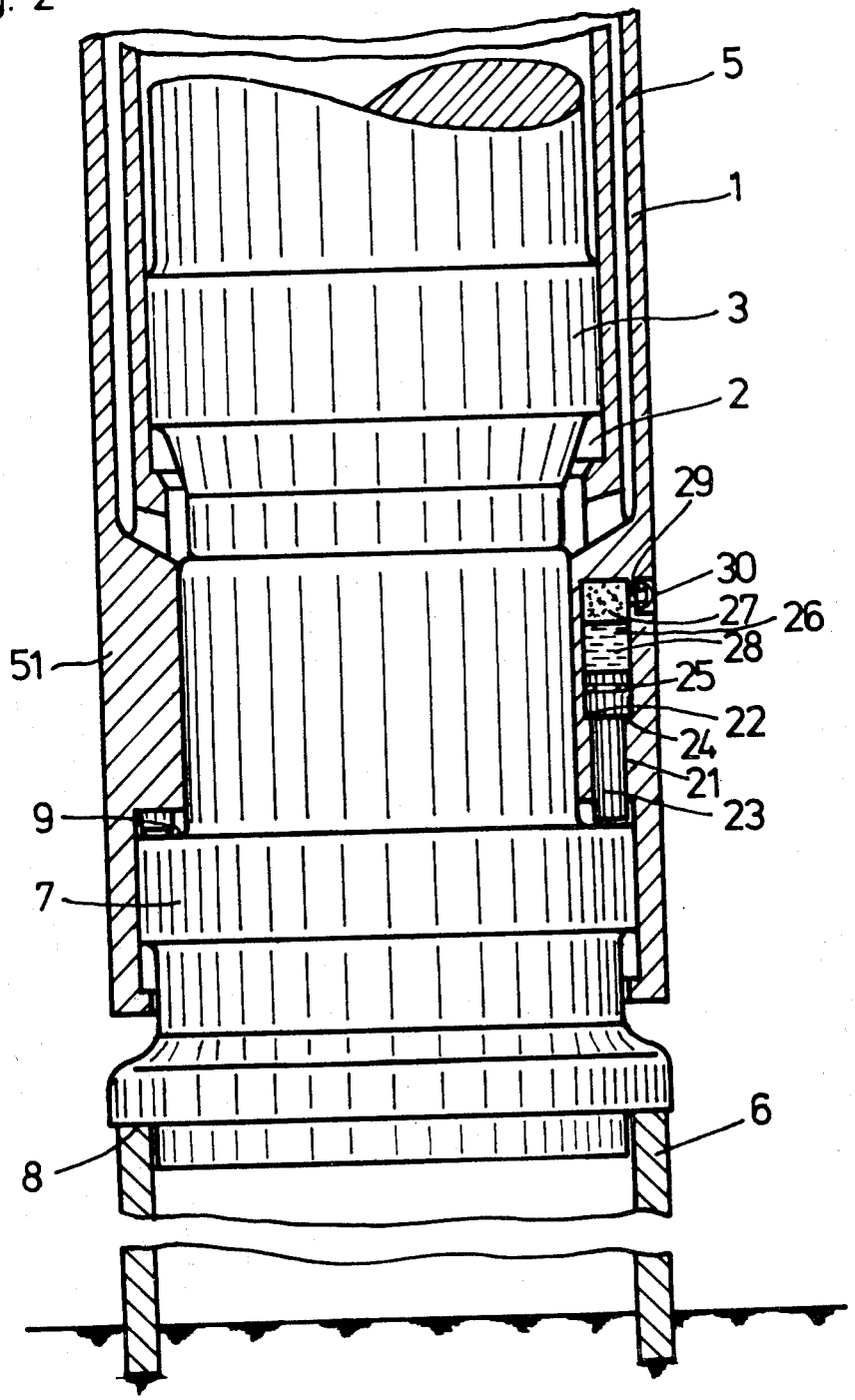
FIG. 2 is a view similar to FIG. 1 of a second embodiment of this invention.

FIG. 2 shows a second embodiment of the present invention which in principle corresponds to the first embodiment disclosed. However, in this second embodiment, bores 21 are used instead of surfaces 11 and 12. The bores are located in an annular flange 51 which projects radially inwardly from the cylindrical internal surface of housing 1, and are uniformly spaced along the circumference of flange 51 and are oriented parallel to the longitudinal axis of the housing 1. A vertically elongated piston 23 with an enlarged head at its top is received in each of the bores 21 for limited vertical movement therein and bounds the bottom of a compartment 26 in each bore. Each bore 21 is formed with an annular step 22 which cooperates with an annular collar 24 of the piston 23 to limit the downward movement of the piston 23 within the bore. Furthermore, a toroidal seal 25 is so provided on the head of piston 23 as to press against the surface which bounds the bore 21. The lower end face of each of the pistons 23 cooperates with the annular support surface 9 of ram follower 7. Again, liquid and gas are contained in compartment 26 to form an upper gas cushion 27 and a lower cushion 28. The top of compartment 26 communicates with a pressure-medium channel 29 which is equipped with a closing valve 30. Thus, as before the liquid cushion 28 and the gas cushion 27 can be brought to that superatmospheric pressure which is proper, considering the particular pile 6 to be driven and the strata resistance encountered, by introducing liquid and/or gas under pressure into the compartment 26 through the pressurized medium channel 29.

Inasmuch as the bores 21 which accommodate the pistons 23 are spaced uniformly around the periphery of the housing 1, and inasmuch as the lower end faces of the pistons 23 are likewise pressed uniformly against the support surface 9 of the ram follower 7, the pistons 23 will be substantially uniformly forced upwardly against the pressurized contents of compartments 26 during the resilient recoil of the pile 6 which occurs immediately after the pile 6 has been driven downwardly by ram follower 7. As before, upward movement of the pistons 23 reduces the volumes of compartments 26 and causes the pressure within the compartments 26 to rise, until equilibrium is established and the recoil shock is absorbed by the gas.

In this second embodiment, the compartments 26 can communicate with one another through conventional passageways (not shown), equalizing the pressure in all the compartments. Since flange 51 extends radially inwardly from the cylindrical internal surface of the housing 1, below ram 3 and above ram follower 7 to the periphery of ram follower 7, no increase in internal diameter of housing 1 is necessary, and housing 1 can again have an external diameter which is only slightly larger than ram 3 and ram follower 7. Thus, the outer diameter of the housing 1 only slighly exceeds the diameter of the tubular pile 6, so that the housing 1 of the pile drive can follow the top end of the pile 6 through any pile guides which may surround the pile 6 during driving.

Figure 3:
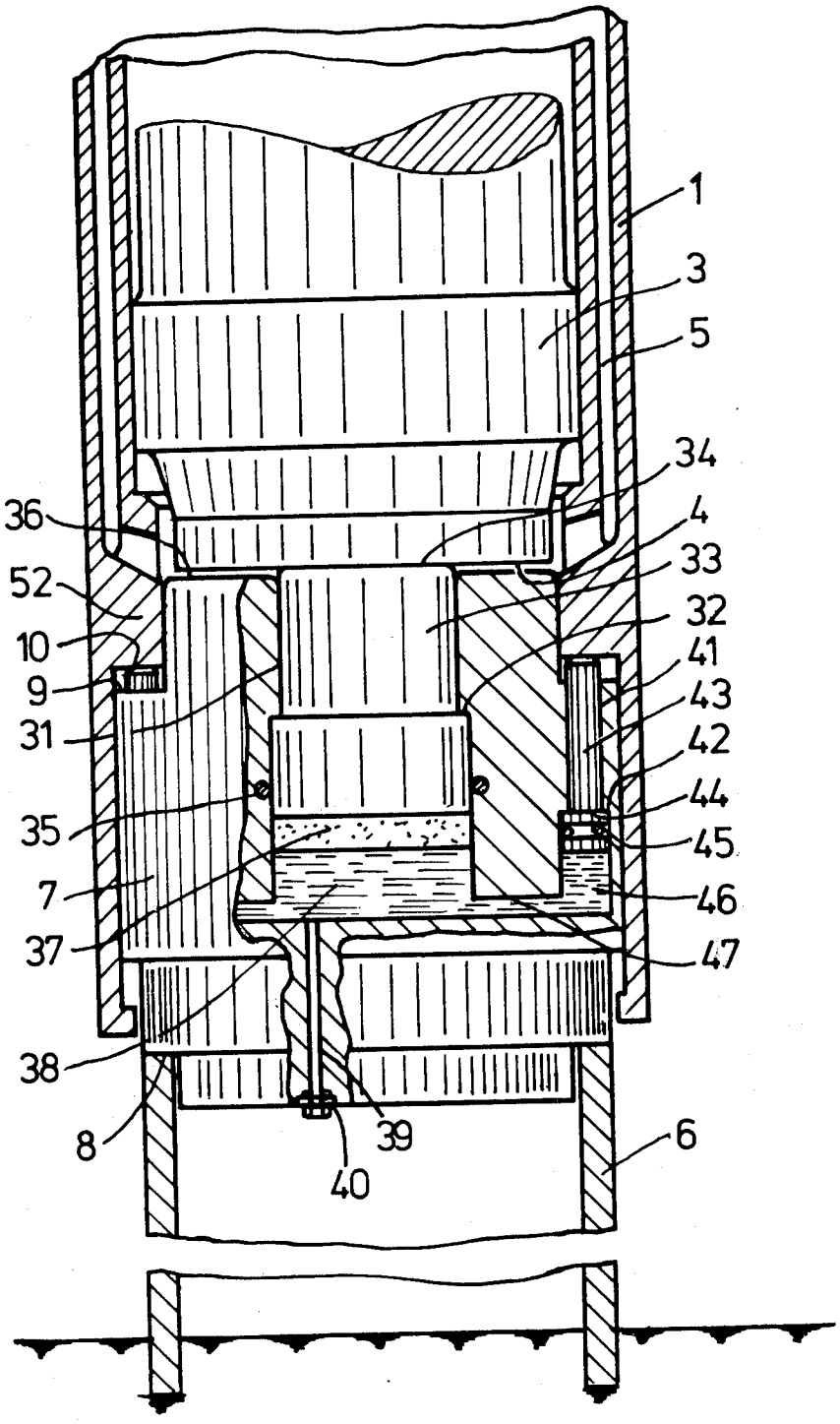
FIG. 3 is a view similar to those of FIGS. 1 and 2 of a third embodiment of this invention.

A third embodiment of the invention is illustrated in FIG. 3 of the drawing, wherein the ram follower 7 (which is arranged between the top end of the pile 6 and the ram 3) is received in a hollow cylindrical housing 1 for reciprocation, is provided with a well 31 which has an annular step 32 and is coaxially with the axes of ram follower 7 and housing 1. An impact piston 33 provided with a corresponding annular collar is slidable within well 31 along a limited vertical distance. The circular ramming surface 4 which is located at the lower end of ram 3 will, during ramming, strike the circular end face 34 of the impact piston 33 and the annular top surface of ram follower 7 which surrounds the piston. A toroidal seal 35 is arranged between the impact piston 33 and the surface bounding the well 31. The impact piston 33 partially bounds a chamber which is coaxially arranged within the ram follower 7. As before, a lower liquid cushion 38 and an upper gas cushion 37 are accommodated within the chamber and the well 31. An upwardly extending pressure medium channel 39 is provided, which is closed by a closing valve 40.

The ram follower 7 again has an annular support surface 9 which is formed by an annular shoulder provided near upper end of the ram follower 7. The ram follower 7 is further provided, in that outer peripheral region which is bounded by the support surface 9, with a plurality of vertically elongated bores 41 which are spaced uniformly around the circumference of support surface 9. Each of the bores 41 has a radially extending annular step 42 intermediate its top and bottom. A substantially cylindrical piston 43 is accommodated in each of the bores 41 for limited vertical movement therein and is provided at its lower end with an annular collar 44 to limit such motion. A toroidal seal 45 is arranged between the piston 43 and the surface bounding the bore 41. The piston 43 partially bounds a compartment 46, each of the compartments 46 being in communication, through a connecting channel 47, with the chamber and the well 31. As a result of the superatmospheric pressure within the bore 31, the chamber, the connecting channels 47 and the compartments 46, all the pistons 43 are pressed upwardly. An annular flange 52 extends radially inwardly from the cylindrical interior surface of housing 1 between ram 3 and support surface 9 of ram follower 7. The annular flange 52 is provided, at its lower face, with an annular support surface 10 which is abutted by the upper end faces at the tops of pistons 43.

The impact piston 33 is urged by the superatmospheric pressure of the gas cushion 37 into its extended position in which the annular collar 44 abuts the annular step 32. In this extended position, the upper end face 34 of the impact piston 33 is located approximately 3 to 30 millimeters above the impact surface 36 of ram follower 7. During its downward movement, the ram 3 first hits the upper end face 34 of the impact piston 33 and shifts the impact piston 33 downwardly so that the volume of the gas cushion 37 contained in the chamber of the bore 31 is reduced. Subsequently, the ramming surface 4 of the ram 3 hits the annular impact surface 36 of the follower 7, and the resulting hard metal-to-metal impact is directly transmitted to the pile 6 via the annular striking surface 8 located at the lower end of the ram follower 7. The pile 6 which is set in motion by this impact will be kept in motion by additional increased pressure obtained during the pushing of the impact piston 33 into the well 31, so that the impact piston 33 reassumes its extended position relative to the ram follower 7 in which it abuts the annular step 32.

The recoil which originates in the pile 6 and which is transmitted via the annular striking surface 8 to the ram follower 7, causes the ram follower 7 to move upwardly with respect to the pistons 43 which press against the support surface 10 of the housing component 1. Thus, liquid is expelled from compartments 46 into the chamber and the well 31, which results in a reduction in the volume of, and a corresponding increase in the pressure in, the gas cushion 37. In this manner, the recoil is absorbed without subjecting the housing component 1 to recoil shock. When the number of pistons 43, individual cross-sectional areas of the pistons 43 relative to the cross-sectional area of the impact piston 33, and the adjusted superatmospheric pressure of the gas cushion 37, are properly selected, two desirable results can be achieved. First, the recoil is absorbed and the housing thereby protected. Next, the great impact of the ram 3 on the impact surface 36 of ram follower 7 loosens the pile 6, and the prolonged force applied to the pile thereafter increases the actual movement of the pile.

In all embodiments, the exterior diameter of the housing 1 will not exceed the exterior diameter of the pile by more than 10%.

It will be understood that each of the elements described above, or two or more together, may also find a useful application in other types of constructions differing from the types described above.

While the invention has been illustrated and described as embodied in an arrangement for driving large-diameter, tubular piles, it is not intended to be limited to the details shown, since various modifications and structural changes may be made without departing in any way from the spirit of the present invention. So, for instance, the pressure of the respective gas cushion can be adjusted to the respective pile-driving conditions even during the operation of the arrangement by a corresponding control of the respective closing valve and of the pressure of the fluid admitted therethrough.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pile driver which utilizes a hollow, axially elongated housing having a substantially cylindrical wall and an open bottom end, a ram closely and slidably guided within the housing and axially reciprocatable therein along a path, a ram follower slidably guided within the housing to execute limited axial movement and having (a) an upper surface which can be struck by the ram (b) a lower surface opposed to the upper surface, which lower surface can strike a pile to be driven and (c) an outer support flange integrally formed on the ram follower and projecting radially outwardly of the upper surface, and an inner support flange projecting radially inwardly from the wall of the housing between the outer support flange and the path, said inner support flange being axially opposed to said outer flange; and at least one piston located between the support flanges, said at least one piston having a free end abutting on one of the support flanges and being slidably guided by another of the support flanges for limited axial movement parallel to the axis of the housing into and out of a corresponding closed compartment bounded by said another of the support flanges, which compartment is sealed by its corresponding piston, whereby compartment volume is reduced upon displacement of its corresponding piston towards said another of the support flanges; and means for introducing and retaining a pressurized gas cushion within said compartment, which gas cushion urges the free end of said at least one corresponding piston against said one of the support flanges.

2. The pile driver defined by claim 1, wherein said another of the support flanges has a larger cylindrical guide surface and a smaller cylindrical guide surface, the guide surfaces being concentric and coaxially aligned with the housing and bounding the compartment, and wherein there is one piston which is hollow and generally cylindrical and which is movable upwardly and downwardly between the guide surfaces while maintaining sealing contact therebetween.

3. The pile driver defined by claim 2, wherein said another of the support flanges is the inner support flange.

4. The pile driver defined by claim 1, wherein said another of the support flanges has a plurality of axially elongated bores which are axially parallel to the housing and are uniformly circumferentially spaced around said one of the support flanges, and wherein there are a like plurality of pistons, with each piston being slidably and sealingly movable within a corresponding bore, said compartment comprising a plurality of compartments each being formed by a corresponding bore and being delimited by a corresponding piston.

5. The pile driver defined in claim 4, wherein said another of the support flanges includes a plurality of passageways which connect the compartments together.

6. The pile driver defined by claim 4, wherein said another of the support flanges is the outer support flange and the bores are located within the ram follower.

7. The pile driver defined by claim 4, wherein said another of the support flanges is the inner support flange.

* * * * *